US007458186B2

(12) United States Patent
Carter

(10) Patent No.: US 7,458,186 B2
(45) Date of Patent: Dec. 2, 2008

(54) DOME-SHAPED STRUCTURE

(76) Inventor: Philip R. Carter, 188 E. 78th St., Apt. 21B, New York, NY (US) 10021

( * ) Notice: Subject to any disclaimer, the term of this patent is extended or adjusted under 35 U.S.C. 154(b) by 568 days.

(21) Appl. No.: 11/325,671

(22) Filed: Jan. 4, 2006

(65) Prior Publication Data

US 2007/0151170 A1 Jul. 5, 2007

(51) Int. Cl.
*E04B 7/08* (2006.01)

(52) U.S. Cl. ..... 52/81.1; 52/80.1; 52/82; 446/108; 446/111; 446/122

(58) Field of Classification Search ..... 52/80.1, 52/81.1–81.5, 263, 582.1, 575; 446/108, 446/111, 112, 122, 123; 264/32, 35; 135/906
See application file for complete search history.

(56) References Cited

U.S. PATENT DOCUMENTS

| | | | | | |
|---|---|---|---|---|---|
| 1,398,852 | A | | 11/1921 | Gilbert | |
| 2,879,553 | A | | 3/1959 | Keating | |
| 2,910,737 | A | * | 11/1959 | MacMillan | 52/81.1 |
| 2,958,918 | A | * | 11/1960 | MacMillan | 264/220 |
| 3,881,284 | A | | 5/1975 | Martin | |
| 4,050,184 | A | | 9/1977 | Chiari | |
| 4,075,813 | A | | 2/1978 | Nalick | |
| 4,154,423 | A | * | 5/1979 | Crock | 249/134 |
| 4,720,947 | A | * | 1/1988 | Yacaboni | 52/81.3 |
| 4,784,172 | A | * | 11/1988 | Yacoboni | 135/87 |
| 5,400,554 | A | * | 3/1995 | Lo | 52/126.5 |
| 5,485,701 | A | * | 1/1996 | Hecht | 52/80.1 |
| 5,490,362 | A | | 2/1996 | Mercier | |
| 5,651,220 | A | | 7/1997 | Dit Felix | |
| 5,715,854 | A | * | 2/1998 | Andrieux et al. | 135/94 |
| 5,862,643 | A | * | 1/1999 | Schilham | 52/745.19 |
| 5,916,097 | A | * | 6/1999 | Markuten | 52/81.2 |
| 6,134,849 | A | * | 10/2000 | Holler | 52/80.1 |
| 6,421,963 | B1 | * | 7/2002 | Pratola | 52/81.1 |
| 6,766,623 | B1 | | 7/2004 | Kalmay | |
| 2003/0177723 | A1 | * | 9/2003 | Jakob-Bamberg et al. | 52/263 |

* cited by examiner

*Primary Examiner*—Brian Glessner
*Assistant Examiner*—James J Buckle, Jr.
(74) *Attorney, Agent, or Firm*—Robert D. Katz; Cooper & Dunham LLP

(57) ABSTRACT

The invention provides an igloo-shaped structure formed from a plurality of rectangular shaped blocks having a rim and a trough molded therein. The rim has pins adjacent the corners of the blocks that engage apertures or holes fastening plates. Each fastening plate has four holes to enable it to snap together four blocks. Subsequent rows of blocks may have smaller dimensions so that the assembly curves inward forming the familiar domed shape of an igloo. Curved trapezoidal shaped blocks, also held together with fastening plates, are used to cap off the dome.

12 Claims, 15 Drawing Sheets

DOME-SHAPED STRUCTURE

FIELD OF THE INVENTION

This invention relates to dome-shaped structures, and more particularly to domed-shaped structure suitable for use as toy igloos, or beach or camping shelters.

BACKGROUND OF THE INVENTION

Various domed-shaped structures have been proposed for use as toy igloos, as well as for other uses including beach shelters to protect from sun and sand, or as a camping shelter in lieu of a tent. For example, U.S. Pat. No. 2,910,737 (MacMillan) proposes a structural toy igloo made from curved blocks that can be fitted together or fastened using tabs that hold the blocks together.

U.S. Pat. No. 5,485,701 (Hecht) discusses a toy igloo including a shell of several pieces that hook together at their edges. The igloo may be used as a support for snow or as an igloo-shaped shelter in the absence of snow.

U.S. Pat. No. 4,075,813 (Nalick) provides a dome construction method using regular hexagonal and semi-hexagonal structural units interconnected using a wooden structure to form a dome structure. The dome is said to be useful for mass production of more permanent domed structures.

U.S. Pat. No. 1,398,852 (Gilbert) shows a building toy that fastens rectangular strips of cardboard together to form the walls and roofs of a house or other building. The system uses clips of tin or brass to hold the strips together.

Despite the foregoing contributions of others, there exists a need for a simple, inexpensive, easy-to-assemble dome-shaped structure that can be used as a toy igloo for children or as a sand, wind, rain, or sun shelter or deflector for adults on the beach or in similar places. It is therefore an object of the invention to provide a dome-shaped temporary shelter for use as a toy igloo or as a shelter for use on the beach or while camping, or as shelter for industrial or emergency use.

SUMMARY OF THE INVENTION

The foregoing objects of the invention are achieved, and the disadvantages of prior structures overcome by providing an igloo-shaped structure for use as a toy or a portable shelter, comprising: a plurality of first rectangular blocks, each first rectangular block having a defined length and width, and having a rectangular shaped trough with a rim surrounding the trough, the rim having adjacent each corner of the block a pin for engaging a fastening plate. The structure also includes a plurality of second rectangular blocks, each second rectangular block having a defined length and width less than the length and width of the first rectangular block. The second rectangular blocks also have a rectangular trough and a rim surrounding the trough. The rim has at adjacent each corner of the block a pin for engaging a fastening plate.

A plurality of curved trapezoidal top pieces serve to form a dome atop the igloo-shaped structure; each curved trapezoidal top piece includes a trapezoidal shaped trough, with a rim surrounding the trough, the rim having at adjacent each corner thereof a pin for engaging a fastening plate.

The igloo is assembled with a plurality of fastening plates, each fastening plate having a substantially square shape and including an aperture in each of four corners of the fastening plate for capturing or engaging a pin on a rectangular block or a curved trapezoidal top piece. Thus, the first and second rectangular pieces and the trapezoidal top pieces join together with the fastening plates to form an igloo-shaped structure.

BRIEF DESCRIPTION OF THE DRAWINGS

Further features and advantages of the invention may be understood by reviewing the following detailed description of the preferred embodiments taken in conjunction with the attached drawings in which.

DETAILED DESCRIPTION OF THE PREFERRED EMBODIMENTS

Figure 1A:
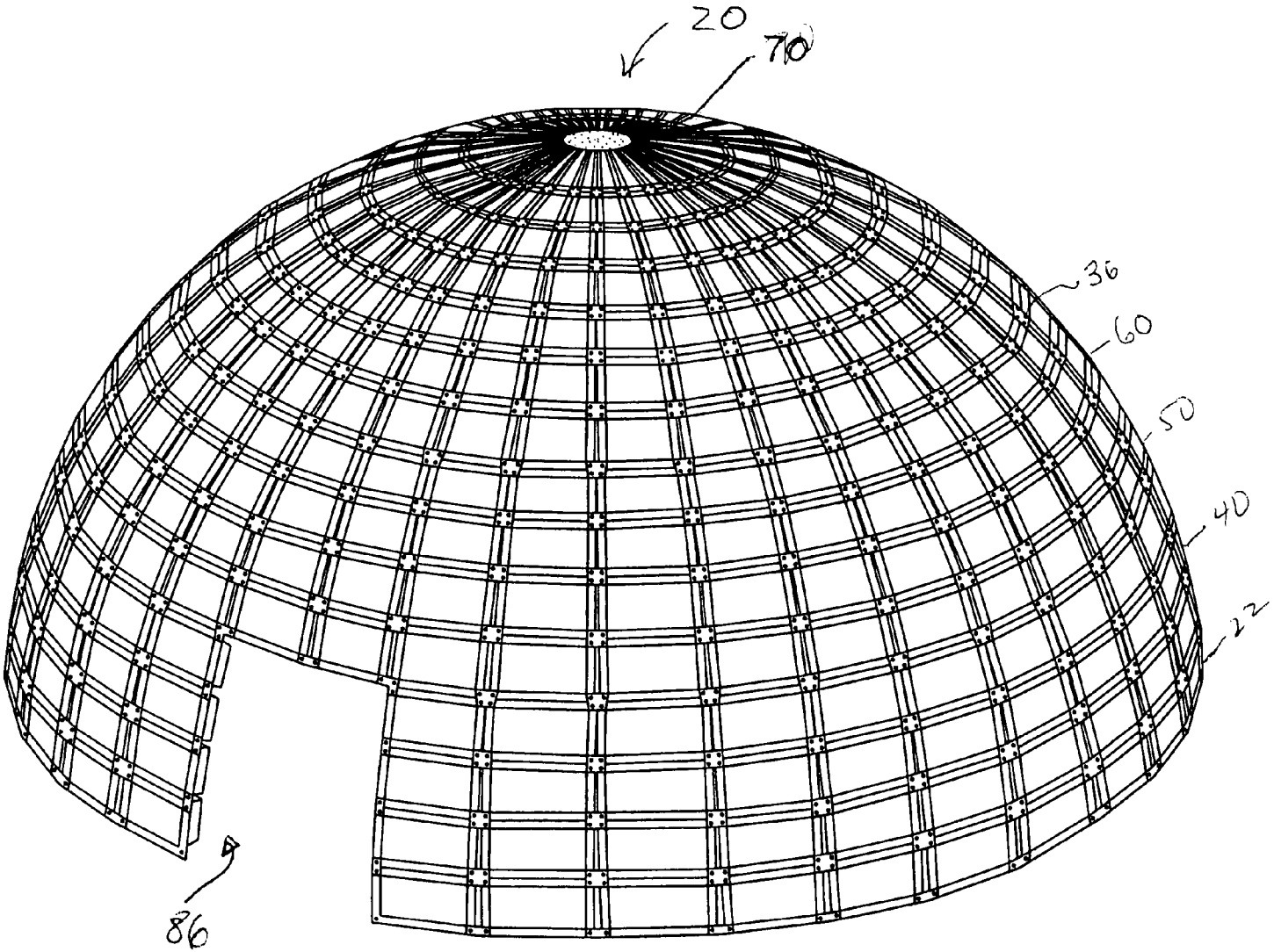
FIG. 1A is a perspective view of a first preferred embodiment of the igloo-shaped structure of the present invention.

FIG. 1A illustrates a first preferred embodiment of the igloo-shaped structure of the present invention, generally referred by reference number 20. The igloo-shaped structure 20 is assembled from first 22, second 40, third 50, and fourth 60 rectangular blocks, and curved trapezoidal blocks 70 held together with fastening member plates 36.

Figure 2A:
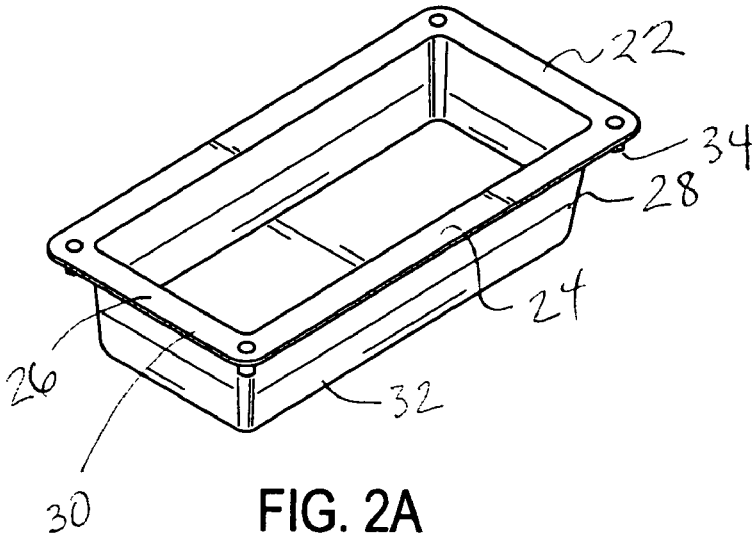
FIG. 2A is a perspective view of a first rectangular plastic block for use in building the igloo-shaped structure of FIGS. 1A-C.
Figure 2B:
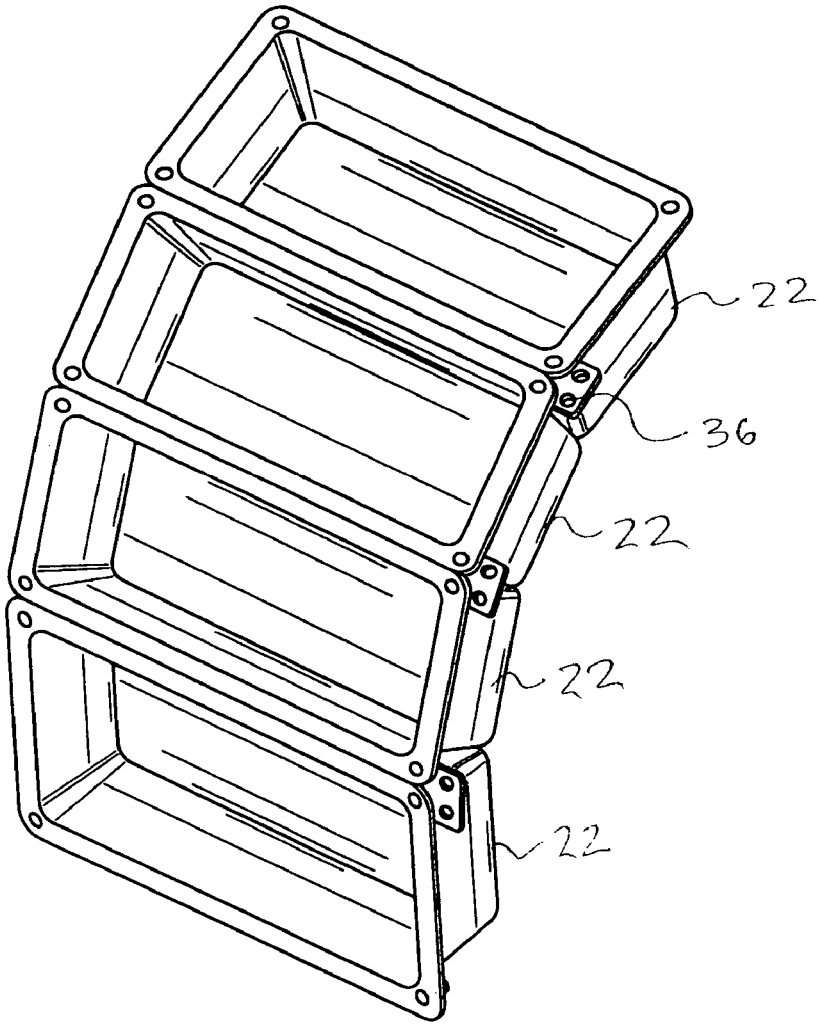
FIG. 2B shows a series of the first rectangular plastic blocks of FIG. 2A fastened together using fastening plates for assembling the igloo-shaped structure of FIGS. 1A-C.
Figure 3A:
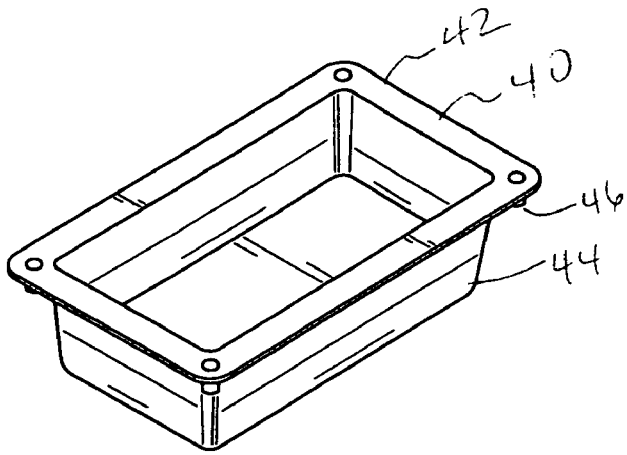
FIG. 3A is a perspective view of a second rectangular plastic block for use in building the igloo-shaped structure of FIGS. 1A-C.
Figure 3B:
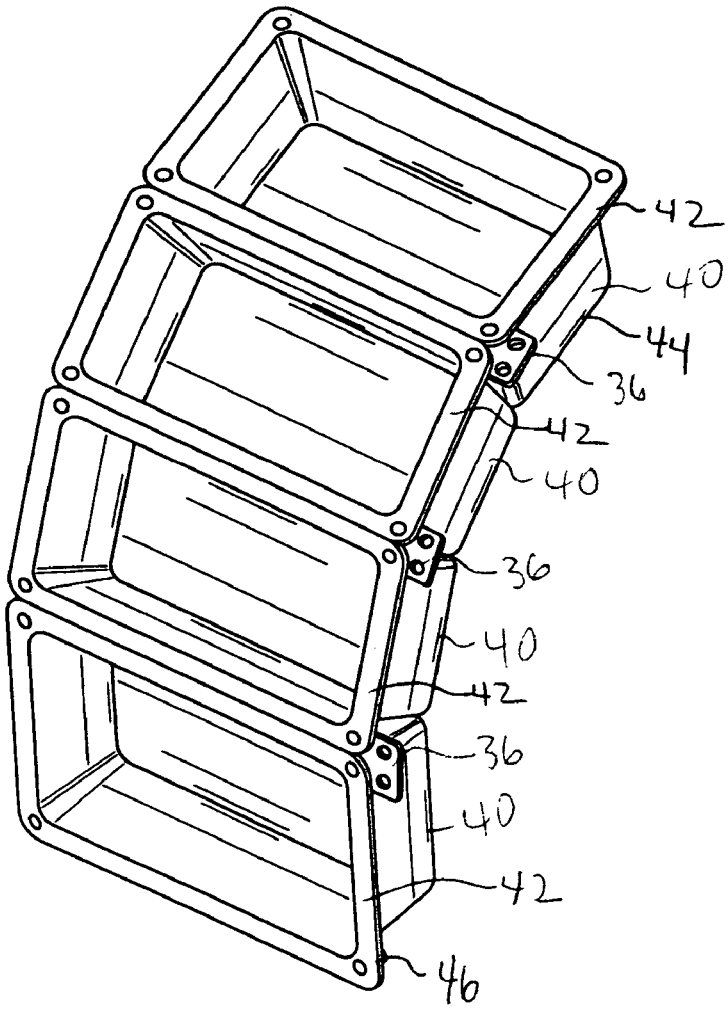
FIG. 3B shows a series of the second rectangular plastic blocks of FIG. 3A fastened together using fastening plates for assembling the igloo-shaped structure of FIGS. 1A-C.
Figure 4A:
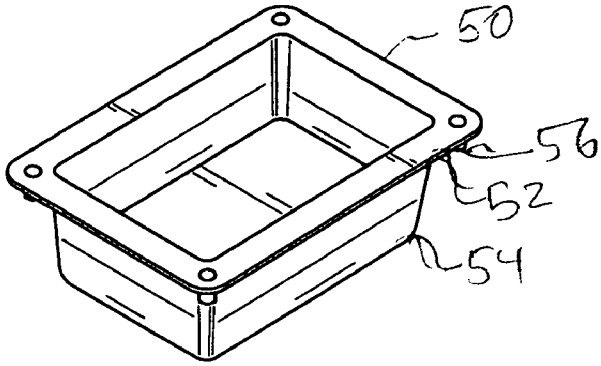
FIG. 4A is a perspective view of a third rectangular plastic block for use in building the igloo-shaped structure of FIGS. 1A-C.
Figure 4B:
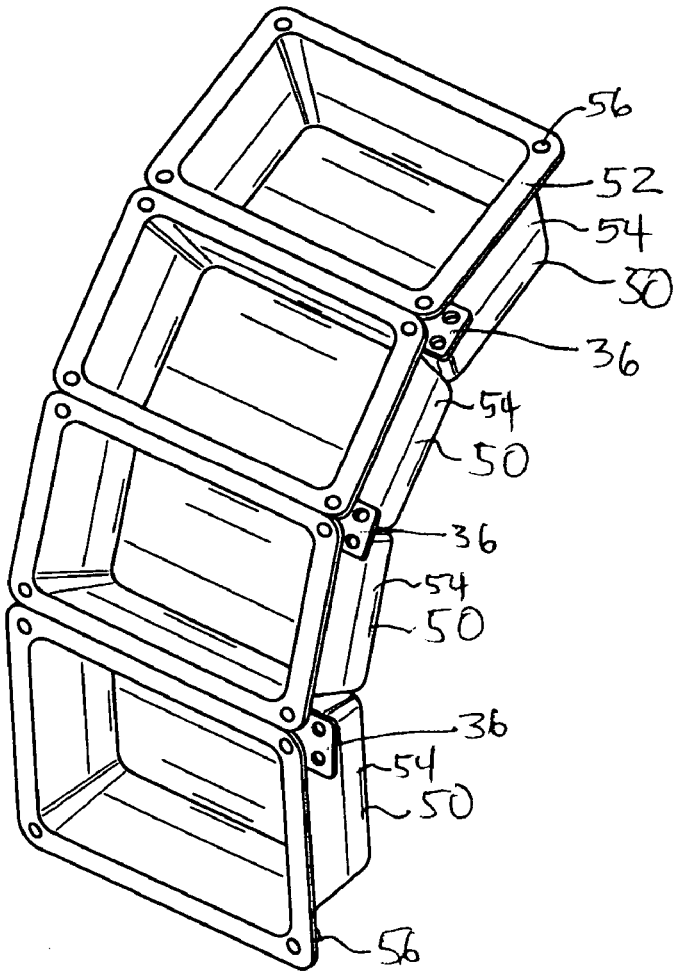
FIG. 4B shows a series of the third rectangular plastic blocks of FIG. 4A fastened together using fastening plates for assembling the igloo-shaped structure of FIGS. 1A-C.
Figure 8:
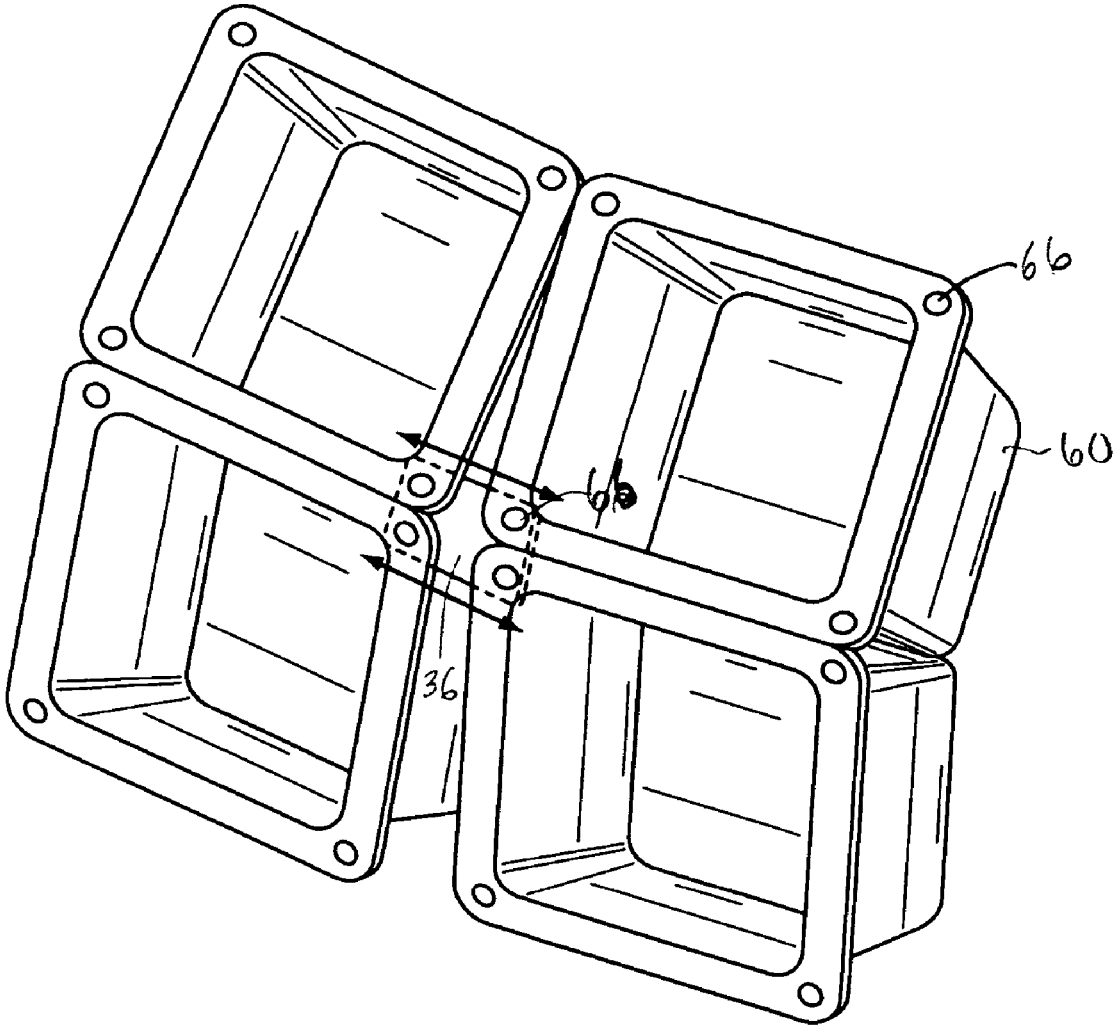
FIG. 8 shows a front perspective view of the four blocks of FIG. 7.
Figure 9:
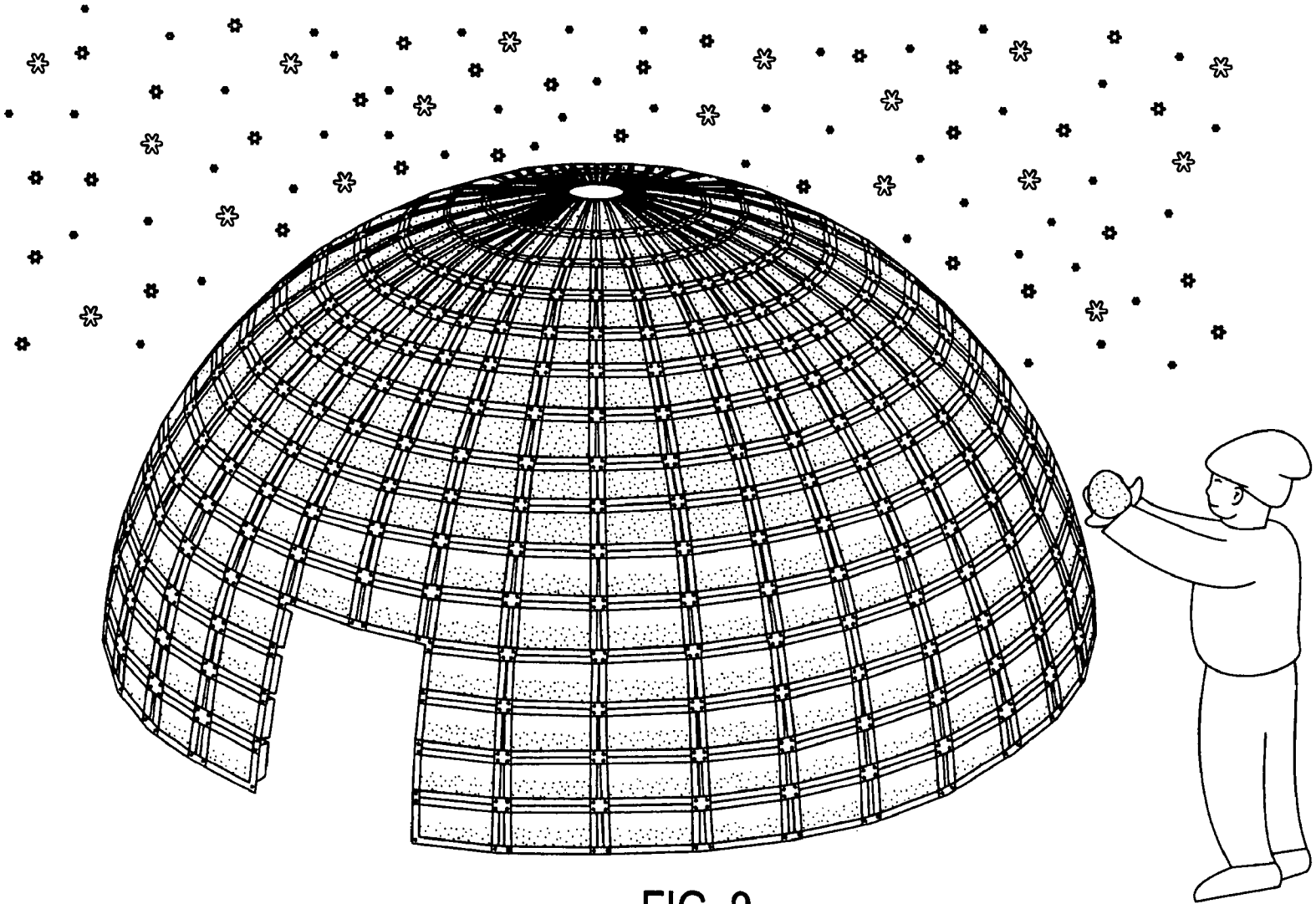
FIG. 9 shows an assembled igloo-shaped structure of FIG. 1A wherein the troughs of the blocks are filled with snow.

As shown in FIGS. 2A and 2B, each of the first rectangular blocks 22 has a length 24 that exceeds the width 26, and includes a trough 28 with a rim 30 surrounding the trough 32. The four corners of the rim 30 each have a pin 34 protruding rearwardly therefrom, to provide a connecting point to join adjacent blocks 22, using fastening members 36 or plates, as shown in FIG. 8. The long side of the rectangular block can also have a pin midway, to allow the blocks to be staggered. Each block 22 can be formed from a single sheet of plastic, and should preferably have sufficient rigidity so that each of the blocks 22 has sufficient strength to form a part of the igloo, and not be crushed or bent by the weight of the blocks above it, although the weight is carried by the sides of the block, like a Roman arch. The exact dimensions of the blocks 22 can vary depending on the desired overall size of the igloo, and can be chosen by a person of ordinary skill without undue experimentation, depending on the desired overall size of the igloo 20. For example, in one embodiment, the first rectangular blocks 22 can be approximately 4 inches wide by 8 inches long, by 4 inches deep. The trough 32 should taper from top to bottom so that the area of the base is less than the area of the opening defined by the rim, to allow the blocks to curve inward, when the igloo is being assembled, as shown in FIGS. 3B and 4B. The integral pin 34 molded into and extending rearward from the rim 30 should be up to about one-half inch long, sufficient to engage the aperture or hole in the fastening member or plate 36 when the two are pressed together.

To obtain a dome effect, after every few rows the size of the building blocks should decrease in length, width, and perhaps depth as one moves upward from the base so that the structure tapers to form a dome. Thus, the second rectangular block 40, shown in FIGS. 3A and 3B should have somewhat smaller dimensions than the first rectangular block 22, for example, approximately 3½ inches wide, 6 to 7 inches long, and about 3½ inches deep, with the sides of the trough 44 sloping inwardly. As with the first rectangular block 22, the second rectangular block 40 has a rim 42 surrounding trough 44, and has four pins 46 adjacent the corners of the block 40 extending from the rim 42. Also, as with the first blocks 22, fastening members 36 connect adjacent blocks 40, as shown in FIG. 4B. Similarly, the third rectangular blocks 50 have still smaller dimensions than the second rectangular blocks 40, as shown in FIGS. 5A and 5B.

The third rectangular blocks 50 are still roughly rectangular in shape, and may have dimensions of about six inches long, three inches high, and about 2½ inches deep, for example. They also have a rim 52, a trough 54, and pins 56 in the four corners of the rim 54. Once again, the dimensions of the third rectangular blocks 50 may be adjusted to suit the overall size of the igloo 20, as well as the constraints created by the overall curvature of the igloo 20 and the size of the blocks both below and above the third rectangular blocks 50. For other uses, for example, industrial or emergency shelters each could be several feet long.

Figure 5A:
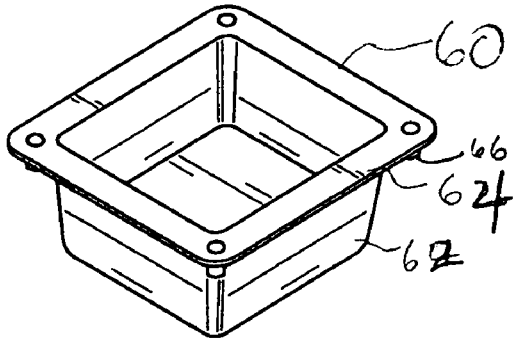
FIG. 5A is a perspective view of a fourth rectangular plastic block for use in building the igloo-shaped structure of FIGS. 1A-C.
Figure 5B:
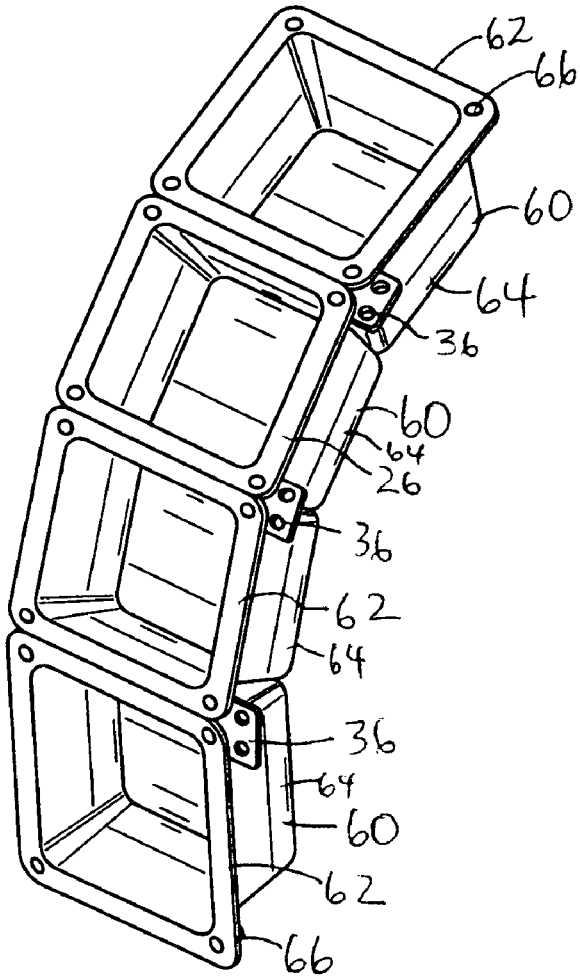
FIG. 5B shows a series of the fourth rectangular plastic blocks of FIG. 5A fastened together using fastening plates for assembling the igloo-shaped structure of FIGS. 1A and 1B.

A fourth rectangular block 60, shown in FIGS. 5A and 5B, also has an approximately square shape. It has a trough 62, a rim 64 around the trough 62, and pins 66 in the corners of the rim 64. The dimensions of the approximately square fourth rectangular block 60, which fits between the third rectangular block 50 and the curved trapezoidal or pie shaped pieces 70 that form the uppermost portion of the igloo 20, vary according to the spatial dictates of the pieces above and below, and can be adjusted (along with the dimensions of the other pieces) to arrive at the desired igloo 20 size. A person of ordinary skill can start with the desired final igloo height, for example three or five feet tall at the center, and work backwards to determine the size of each of the rectangular pieces. The exact dimensions usually are not critical, and may be adjusted according to the intended purpose of the igloo 20. For example, a child's toy could be a dome having a height of about three to five feet, while a beach or camping shelters might have a central height five or more feet, and industrial shelters 30 or more feet. The blocks can also be made much bigger and still be used to make a small igloo. For example, each first rectangular block can be the length of five of the first rectangular blocks described above, and the height of three or more. In that way, fewer blocks are needed, and assembly time is greatly reduced.

Figure 1B:
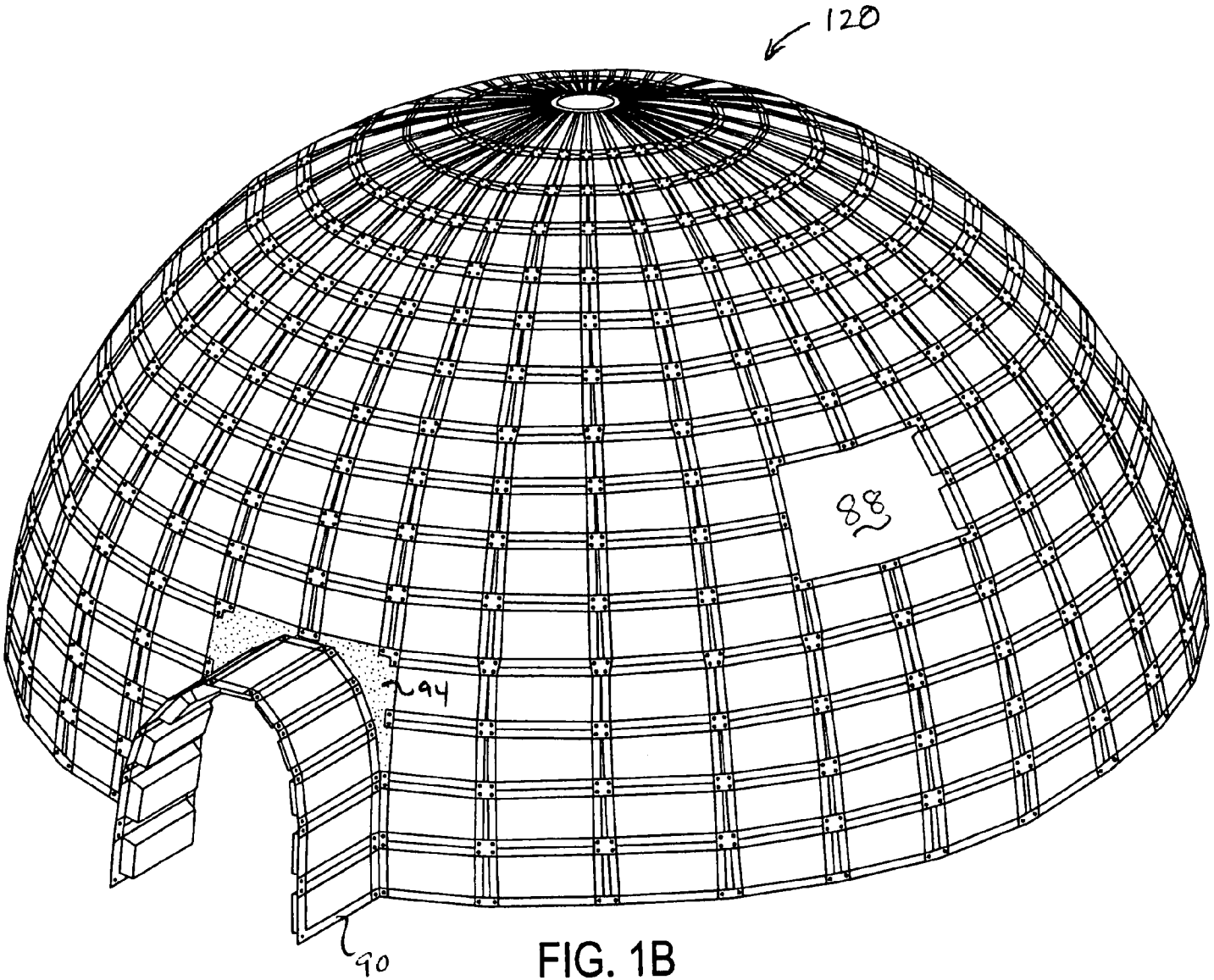
FIG. 1B is a perspective view of a second preferred embodiment of the igloo-shaped structure of the present invention.
Figure 1C:
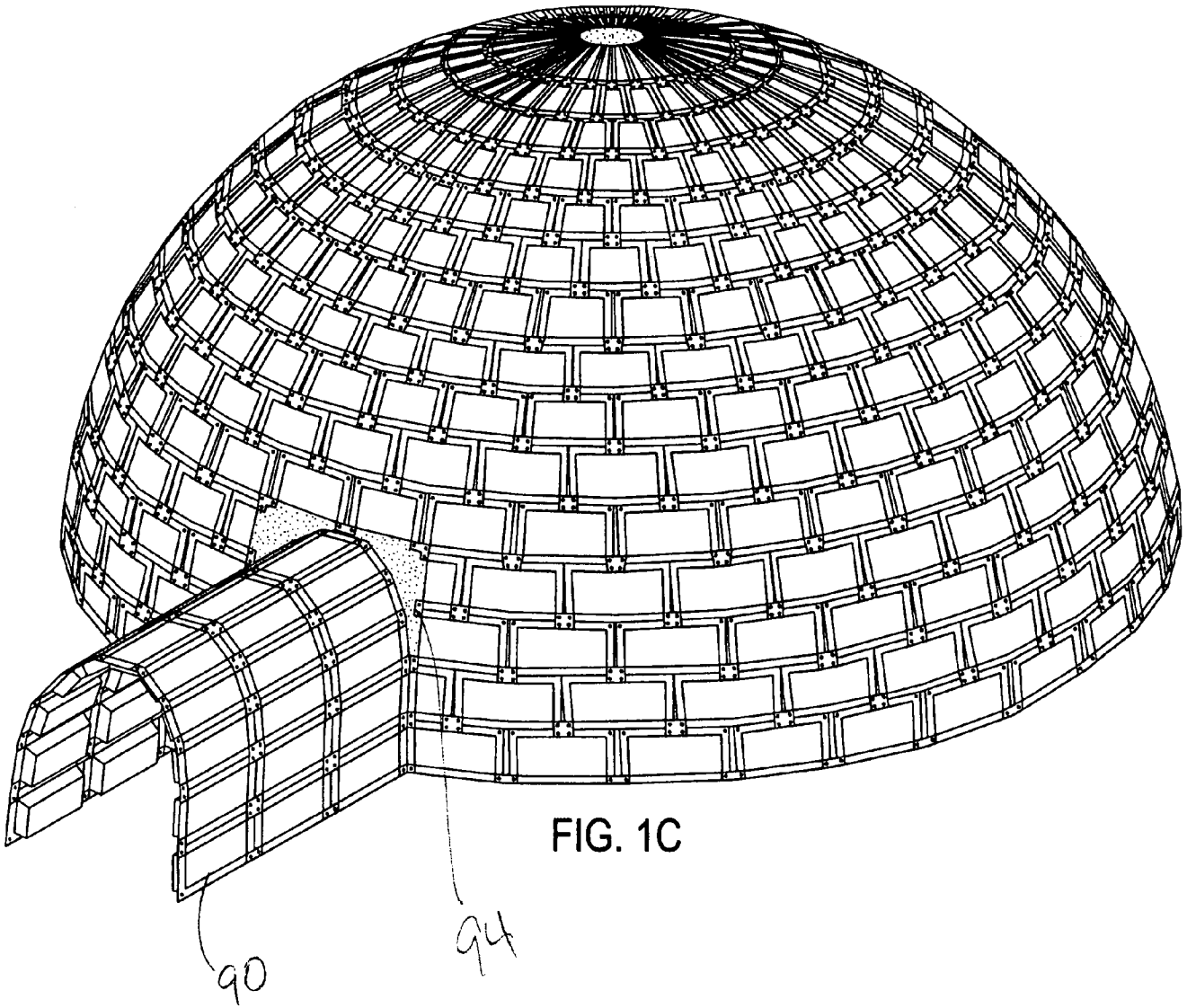
FIG. 1C is a perspective view of a third preferred embodiment of the igloo-shaped structure of the present invention.
Figure 12:
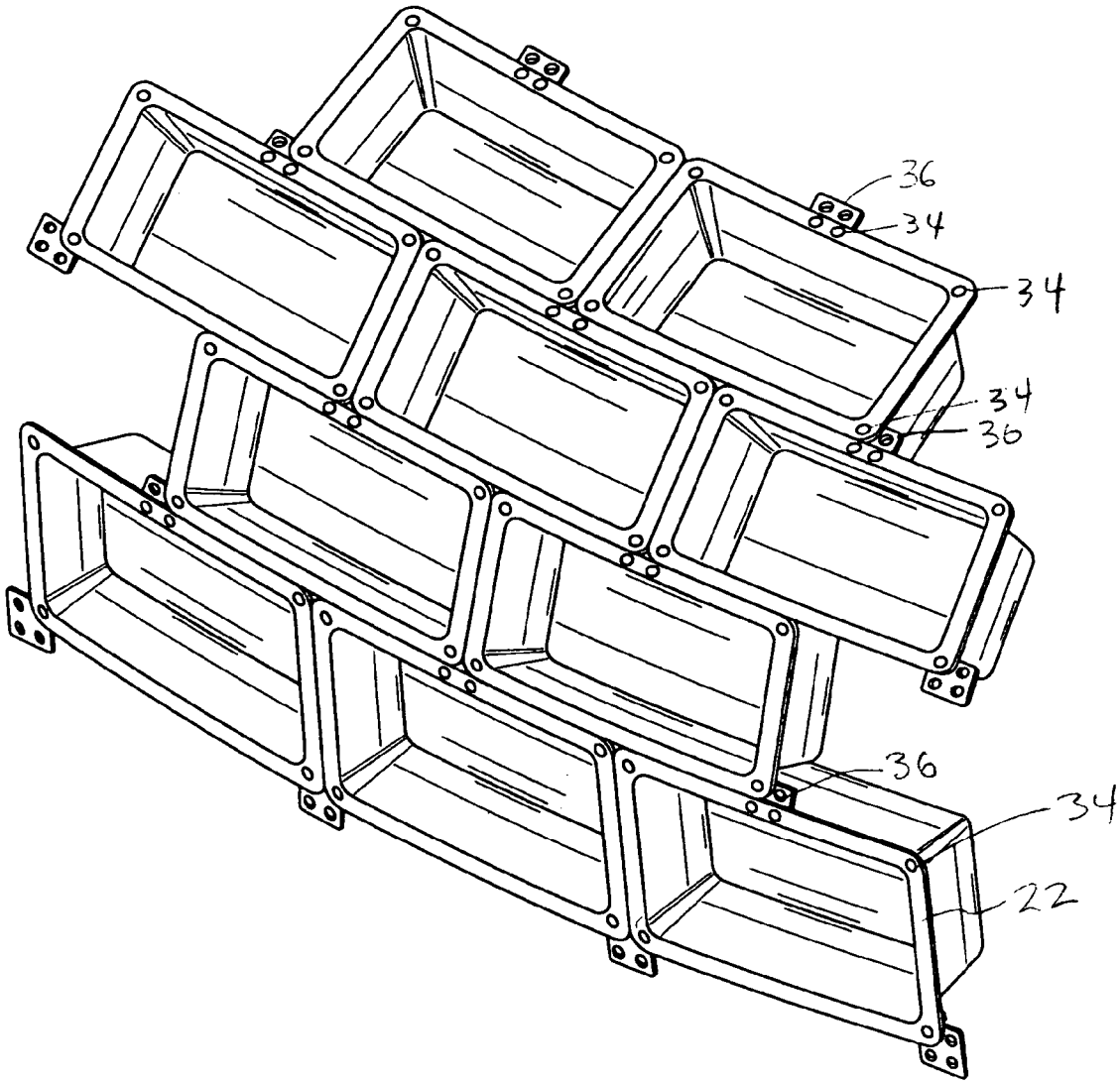
FIG. 12 shows a further embodiment of the invention where the blocks are staggered.

In another embodiment illustrated in FIGS. 1C and 12, the igloo 20 includes staggered blocks to provide a more realistic look. The block used in this embodiment, shown in FIG. 12, has two additional pins 34 on the top center of the rim and two additional pins 34 on the bottom center of the rim. These pins 34 allow the blocks to be staggered, rather than stacked on top of one another, giving a more realistic igloo-like appearance, and perhaps adding a bit of structural strength at the same time.

Figure 6A:
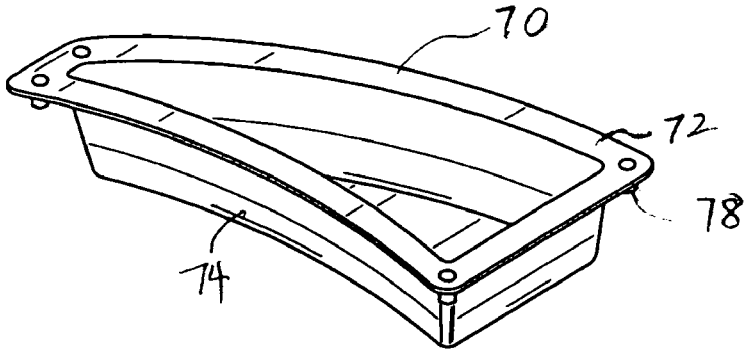
FIG. 6A is a perspective view of a curved trapezoidal plastic block for use in building the igloo-shaped structure of FIGS. 1A and 1B.
Figure 6B:
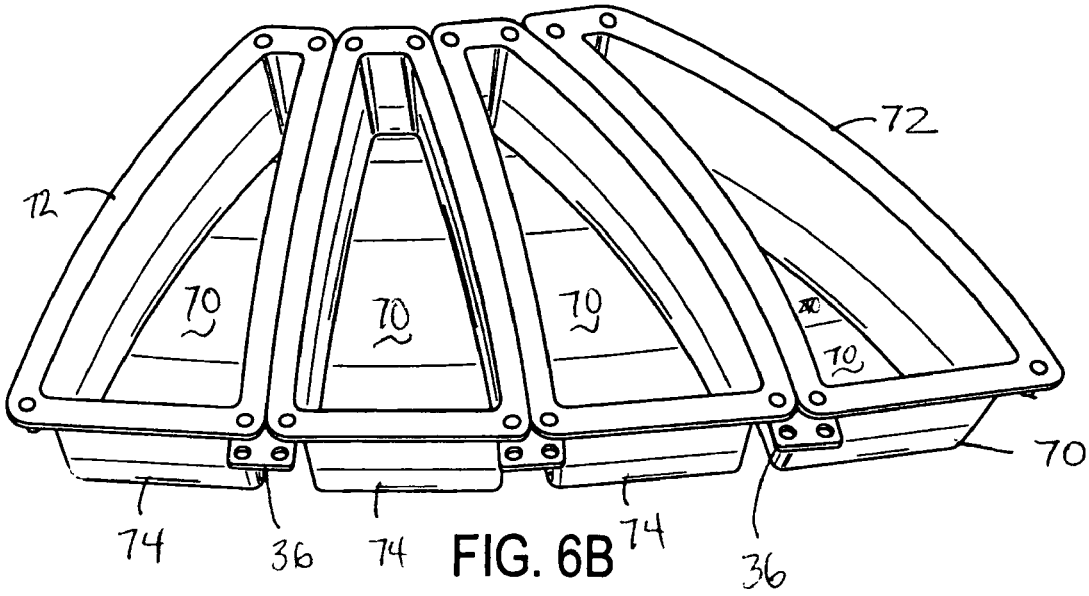
FIG. 6B shows a series of the curved trapezoidal plastic blocks of FIG. 6A fastened together using fastening plates for assembling the igloo-shaped structure of FIGS. 1A and 1B.

Adjacent the top of the igloo 20, as shown in FIG. 1A, where the dome converges, a plurality of curved trapezoidal or triangular blocks 70, each having a trough 74, a rim 76, and four pins 78 serve to top off the dome of the igloo 20 (see FIG. 6A). A number of these curved trapezoidal or triangular blocks or pieces 70 fit together as shown in FIG. 6B, to create the curved portion adjacent the top of the igloo 20. In the embodiment shown herein, the curved trapezoidal or triangular blocks 70 have a slight curvature to them to allow them to nest in a proper array to form the curved dome, as shown in FIG. 6B. The height of the trapezoid or triangle and the amount of curvature can be determined when laying out the various pieces of the igloo 20, to insure that the domed portion has the proper curvature and length.

The rubber fastener plates 36 allow the joints to yield to and stretch, providing flexible strength to the overall structure, as show in FIG. 8. The igloo 20 of the present invention may includes two or three types of fastening members to hold the various blocks or pieces together, shown in FIGS. 6C, 7 and 8, depending on the desired configuration or plates 36. The first fastening plate 80, shown in FIG. 7, is generally square, and has four holes 82, each adjacent to a corner of the square, to hold or engage a pin from one of the first through fourth rectangular blocks. The fastening plate 80 may advantageously be made of natural or artificial rubber, such as latex, or other available elastomer in order to provide stretch or elasticity to the fastening plate 80. This in turn will facilitate assembly, and will keep the igloo, once assembled, from being too rigid. At the same time, the igloo 20 will have some spring or resilience, so that it will yield to bumps received during set up and use. The fastening plate 80 can also be made from a stiffer material, such as polyethylene, colored or left clear, as desired. For industrial applications, the blocks and the plates may be metal, and they may be fastened with nuts and bolts or rivets, and there would be holes instead of pins at the fastening points.

Figure 6C:
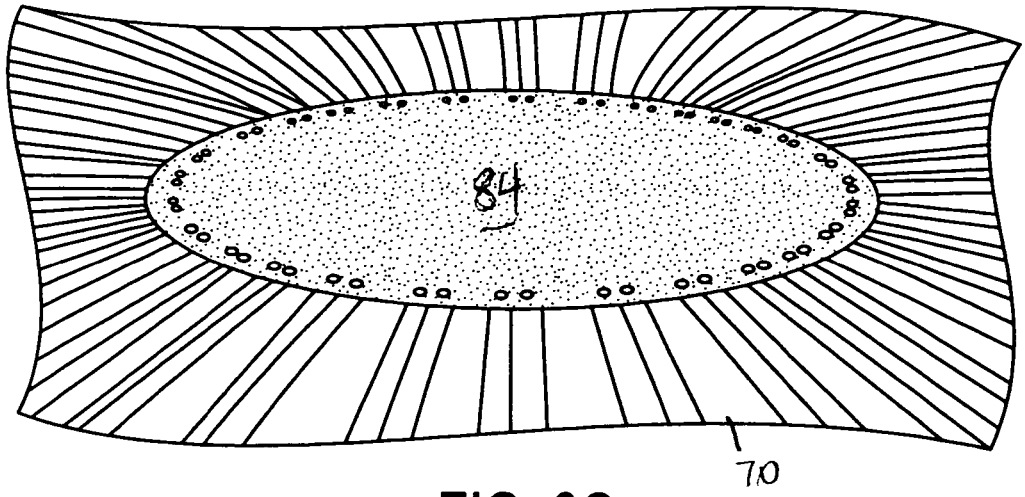
FIG. 6C shows one embodiment of a circular fastening member that holds together the curved trapezoidal plastic blocks at the top of the igloo having a closed top.
Figure 6D:
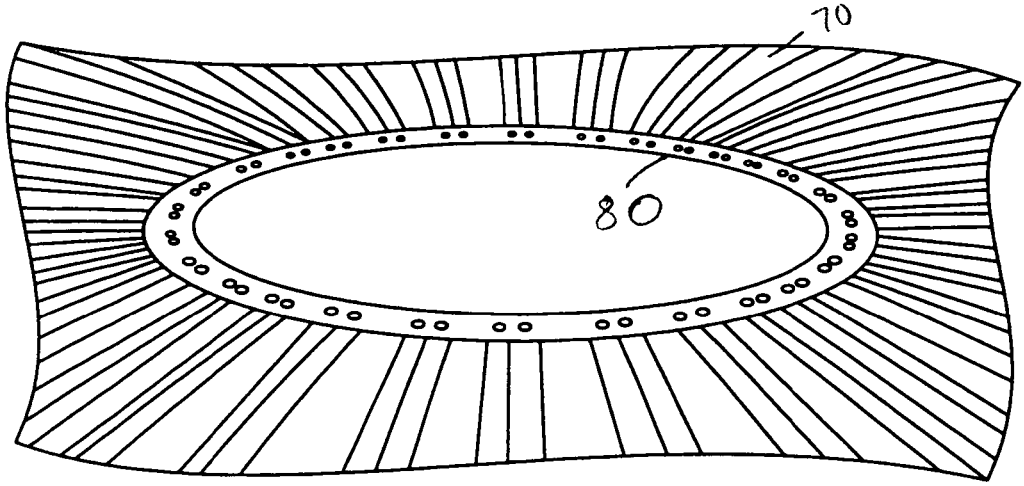
FIG. 6D shows another embodiment of a circular fastening member as shown in FIG. 6C having an open top.
Figure 7:
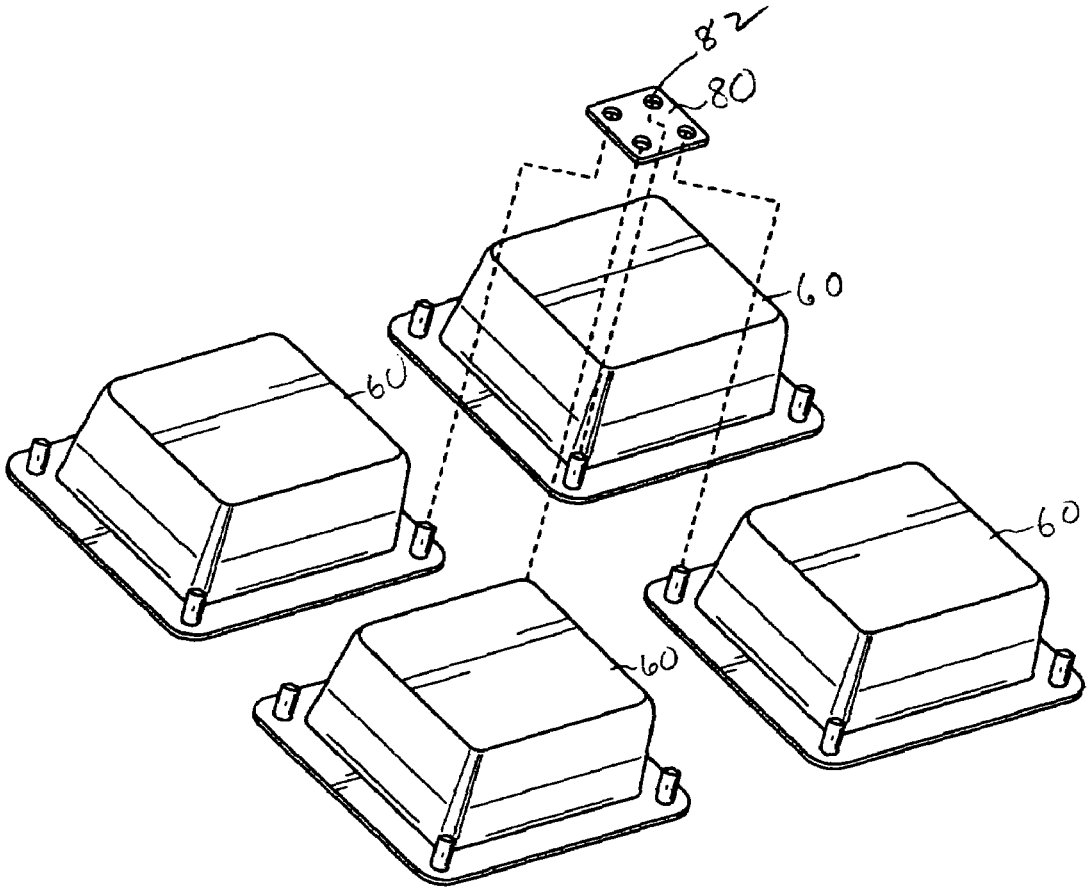
FIG. 7 is an exploded view taken from the rear of the manner of fastening the rear side of four blocks of FIG. 5A with a fastening plate or member.

The second fastening member 84, shown in FIG. 6C, has a roughly circular shape, and includes a plurality of pairs of holes near the circumference to engage pins 78 from the curved trapezoidal pieces or blocks 70. It also closes off the opening at the top of the igloo 20 to keep out wind and precipitation. Other shapes can be used, such as polygons having the same number of sides as the number of trapezoidal pieces 70 to which they attach, and they can be made of the same rubber material as the first fastening plate 80, or it can be a stiffer ring-shaped structure 80 of polyethylene (FIG. 6D), if an opening at the top of the igloo 20 is desired. The interconnection of the blocks into the domed shape adds to the strength of the structure, as would occur with the construction of any dome from a series of blocks.

The front opening 86 to the igloo 20 is created by omitting different pieces, and can vary in size according to the number of pieces omitted (see FIG. 1A). Likewise, the igloo 20 can include one or more windows 88 by omitting several rectangular pieces at a desired location on the side of the igloo 20, as shown in FIG. 1B. The windows 88 can have fasteners 36 as the corners to keep the area surrounding the window 88 secure. If desired, in another embodiment of the invention also shown in FIG. 1B and FIG. 1C, the igloo can include the traditional tunnel 90 entrance, by providing sufficient first or second rectangular pieces to form an arch for the entry tunnel 90. A piece of rubber material 94 having pre-punched holes forms a connector between the tunnel 90 and the igloo 20, as shown in FIG. 1B, and helps to keep out wind and precipitation. The tunnel 90 can have other shapes, such as a peak roof, if desired (not shown).

Figure 10:
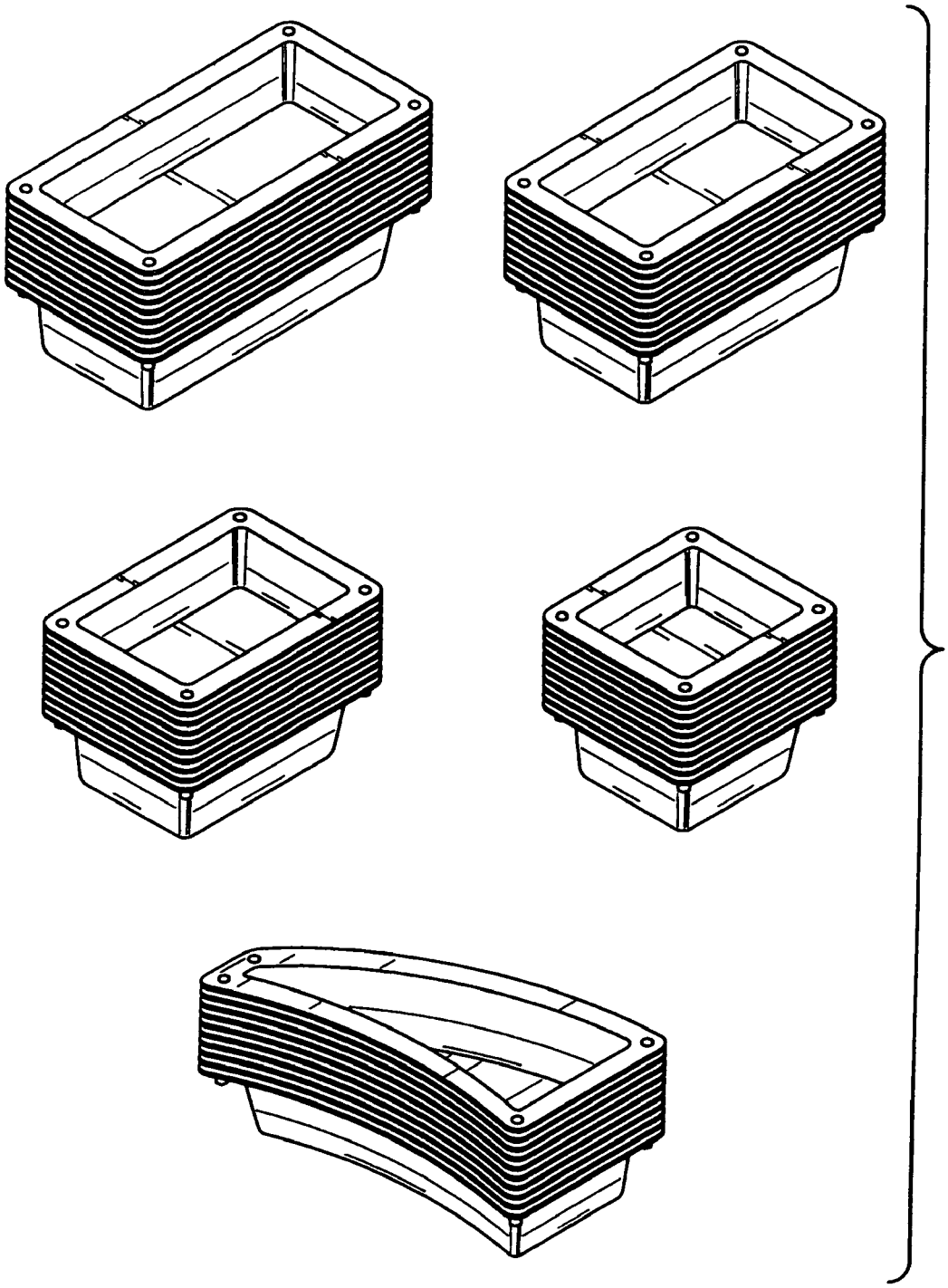
FIG. 10 shows stacks of blocks for use in assembling the igloo-shaped structure of FIGS. 1A and 1B.
Figure 11:
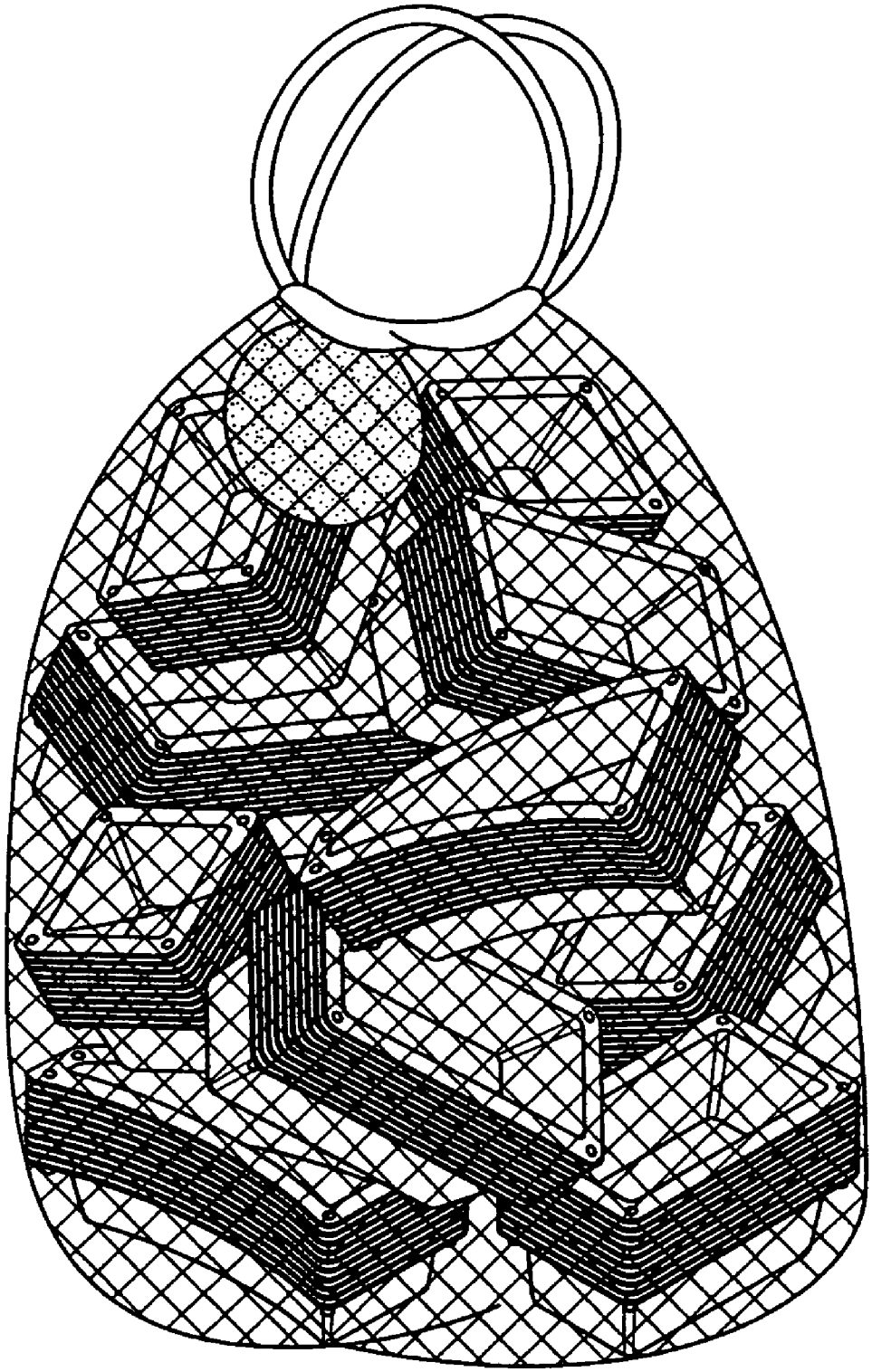
FIG. 11 shows a mesh bag holding the blocks of FIG. 10, as a kit for selling or carrying the blocks for assembling the igloo-shaped structure of the present invention.

It should now be apparent to a person of the ordinary skill that an igloo-shaped structure has been described that has a number of significant advantages. It can be readily made of inexpensive flexible plastic parts, and can be assembled quickly and easily even by a fairly young child. Moreover, the assembly provides an interesting and fun task for children (and others) who enjoy assembling such building structures. Further, the use of several distinctly shaped stackable parts makes disassembly and storage easy, and makes it easy to carry the kit to a friend's house, a playground, the beach, a campground, or to the backyard, as shown in FIGS. 10 and 1. The structure assembles and comes apart easily, so that it can be stored indoors, where it will be protected from the elements, when desired, and from loss of the different pieces. Also, substitute parts are inexpensive to make and are easily available.

The structure can be made of different plastics known to those of ordinary skill in the art, and can be clear, translucent, opaque, white (like snow), or colored. They may also be made of a lightweight metal such as aluminum or titanium, of fiberglass or other composite, to enable use as a beach or other shelter, and can be reinforced with metal strips to make the structure more rigid, permanent, and waterproof. A large structure so made can protect a pile of rock salt, building materials or vehicles from the elements.

In the plastic version, one can fill the trays with foam such as polyurethane or other plastic foam, or with natural or artificial snow for insulation and appearance. One can also fill the trays with sand or a sand mixture for use in a beach or desert shelter. Further, the blocks can be covered with lids, so that the blocks are hollow inside and have the same rim for attachment as the other blocks described herein. The igloo can also be used as a hospitality "tent," and can be decorated, painted, colored or tinted as desired for the particular use. It can be outfitted with a heater, campfire, or stove in the middle. When made of a larger size and stronger materials, it can serve as an industrial or emergency shelter.

The invention has been described herein with reference to the preferred embodiment thereof. Various changes and modifications may be made therein without departing from the spirit and scope of the invention as defined by the following claims.

I claim:

1. An igloo-shaped structure for use as a toy or a portable shelter, comprising:

a plurality of first rectangular blocks, each first rectangular block having a defined length and width, and having a rectangular shaped trough and a rim surrounding the trough, the rim having adjacent each corner of the first rectangular blocks a pin for engaging a fastening plate; and a plurality of second rectangular blocks, each second rectangular block having a defined length and width less than the length and width of the first rectangular blocks, a rectangular trough, and having a rim surrounding the trough, the rim having at adjacent each corner of the second rectangular blocks a pin for engaging a fastening plate;

a plurality of curved trapezoidal top pieces to form a dome atop the igloo-shaped structure, each curved trapezoidal top piece including a 15 trapezoidal shaped trough, with a rim surrounding the trough, the rim having adjacent each corner of the curved trapezoidal top pieces a pin of engaging a fastening plate; and a plurality of fastening plates, each fastening plate having a substantially square shape and including an aperture in each of four corners of the fastening plate for capturing or engaging a pin on a rectangular block or a curved trapezoidal top piece;

whereby the first and second rectangular pieces and the trapezoidal top pieces join together with the fastening plates to form an igloo-shaped structure.

2. An igloo-shaped structure according to claim 1, additionally comprising:

a plurality of third rectangular blocks, each third rectangular block having a rectangular trough and a defined length and width less than the length and width of the second rectangular block and a rim surrounding the trough, the rim having at adjacent each corner of the third rectangular blocks a pin of engaging a fastening plate.

3. An igloo-shaped structure in accordance with claim 2, additionally comprising a plurality of fourth rectangular blocks, having a substantially square shape, a pin adjacent each corner of the fourth rectangular blocks, and a substantially square shaped trough in the center of the fourth rectangular blocks and a rim surrounding the trough.

4. An igloo-shaped structure in accordance with claim 2, wherein the blocks are made from transparent or translucent plastic.

5. An igloo-shaped structure in accordance with claim 4, wherein the plastic is substantially rigid.

6. An igloo-shaped structure in accordance with claim 5, wherein the plastic is polyethylene, polypropylene, or polystyrene.

7. An igloo-shaped structure in accordance with claim 2, wherein the fastening plates are made of natural or synthetic rubber.

8. An igloo-shaped structure in accordance with claim 1, wherein the blocks are aluminum or fiberglass.

9. An igloo-shaped structure according to claim 3, wherein the trough slopes inwardly from therein to allow the rim of the blocks to curve as they are stacked.

10. An igloo-shaped structure according to claim 1, wherein the trough slopes inwardly from therein to allow the rim of the blocks to curve as they are stacked.

11. An igloo-shaped structure according to claim 9, wherein each of the first through fourth rectangular blocks have a pair of additional outwardly extending pins approximately midway on an upper edge of the rim and a pair of additional pins on a lower edge of the rim, to allow the blocks to be staggered.

12. An igloo-shaped structure according to claim 11, additionally comprising a plurality of blocks approximately half the length of the first through fourth rectangular block to start a row such that it will stagger the row above or below.

* * * * *